US011092004B2

(12) United States Patent
Vinay et al.

(10) Patent No.: US 11,092,004 B2
(45) Date of Patent: Aug. 17, 2021

(54) CORRECTING CLOCK DRIFT BETWEEN MULTIPLE DATA STREAMS DETECTED DURING OIL AND GAS WELLBORE OPERATIONS

(71) Applicant: NABORS DRILLING TECHNOLOGIES USA, INC., Houston, TX (US)

(72) Inventors: Namitha Vinay, Cypress, TX (US); Srikanth Valleru, Spring, TX (US); Jayaprasad Jayabal, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 311 days.

(21) Appl. No.: 16/155,524

(22) Filed: Oct. 9, 2018

(65) Prior Publication Data

US 2020/0109623 A1 Apr. 9, 2020

(51) Int. Cl.

| | |
|---|---|
| ***E21B 47/12*** | (2012.01) |
| ***E21B 41/00*** | (2006.01) |
| ***E21B 47/06*** | (2012.01) |
| *E21B 44/00* | (2006.01) |

(52) U.S. Cl.

CPC ..... *E21B 47/12* (2013.01); *E21B 41/0092* (2013.01); *E21B 47/06* (2013.01); *E21B 44/00* (2013.01)

(58) Field of Classification Search

CPC ..... E21B 47/12; E21B 41/0092; E21B 44/00
USPC ..... 702/9
See application file for complete search history.

(56) References Cited

U.S. PATENT DOCUMENTS

| | | | | |
|---|---|---|---|---|
| 9,062,537 | B1 * | 6/2015 | Holt | E21B 44/00 |
| 10,101,486 | B1 * | 10/2018 | Palmer | E21B 47/092 |
| 2007/0213935 | A1 * | 9/2007 | Fagnou | G01V 1/34 702/6 |
| 2013/0146358 | A1 * | 6/2013 | DiSantis | E21B 7/00 175/27 |
| 2016/0333673 | A1 * | 11/2016 | Anno | G05B 15/02 |
| 2018/0187498 | A1 * | 7/2018 | Sanchez Soto | E21B 21/08 |
| 2018/0363398 | A1 * | 12/2018 | Hejleh | E21B 47/12 |
| 2018/0371899 | A1 * | 12/2018 | Switzer | E21B 47/18 |

* cited by examiner

*Primary Examiner* — Ricky Go
(74) *Attorney, Agent, or Firm* — Haynes and Boone, LLP

(57) ABSTRACT

Apparatus, systems, and methods for correcting clock drift between multiple data streams detected during oil or gas drilling operations. The method generally includes drilling a well segment using a drilling rig. During the drilling of the well segment, first and second drilling conditions are detected over a time interval using first and second sensors. First and second data streams based on the detected first and second drilling conditions are received at a surface location. It is then determined, based on a relationship between the first and second drilling conditions, whether the first and second data streams are asynchronous with each other and relative to the time interval. If it is determined that the first and second data streams are asynchronous: an extent to which the first and second data streams are asynchronous is determined; and based on said extent, the first and second data streams are synchronized.

20 Claims, 8 Drawing Sheets

CORRECTING CLOCK DRIFT BETWEEN MULTIPLE DATA STREAMS DETECTED DURING OIL AND GAS WELLBORE OPERATIONS

TECHNICAL FIELD

The present disclosure relates generally to data collection during oil and gas drilling operations and, more particularly, to apparatus, systems, and methods for correcting clock drift between multiple data streams detected during oil or gas drilling operations.

BACKGROUND

During oil and gas wellbore operations (e.g., drilling operations) data is typically received by a control system from multiple sources and displayed as a function of time. However, due to the complex nature of most drilling rigs and the variability in communication methods typically used to communicate various data streams to the control system (e.g., wired, wireless, mud-pulse telemetry, etc.), it is not uncommon for data streams to be received by the control system and displayed to the user such that the respective time intervals over which the data streams are displayed do not accurately correspond to the actual time interval over which the data streams were detected by various sensors. To make things worse, "clock drift" often occurs between the clocks of the various sensors, thereby preventing accurate alignment of the data streams as a function of the actual time interval over which the data streams were detected. Therefore, what is needed is an apparatus, system, and/or method that addresses the foregoing issue(s), and/or one or more other issue(s).

DETAILED DESCRIPTION

Figure 1:
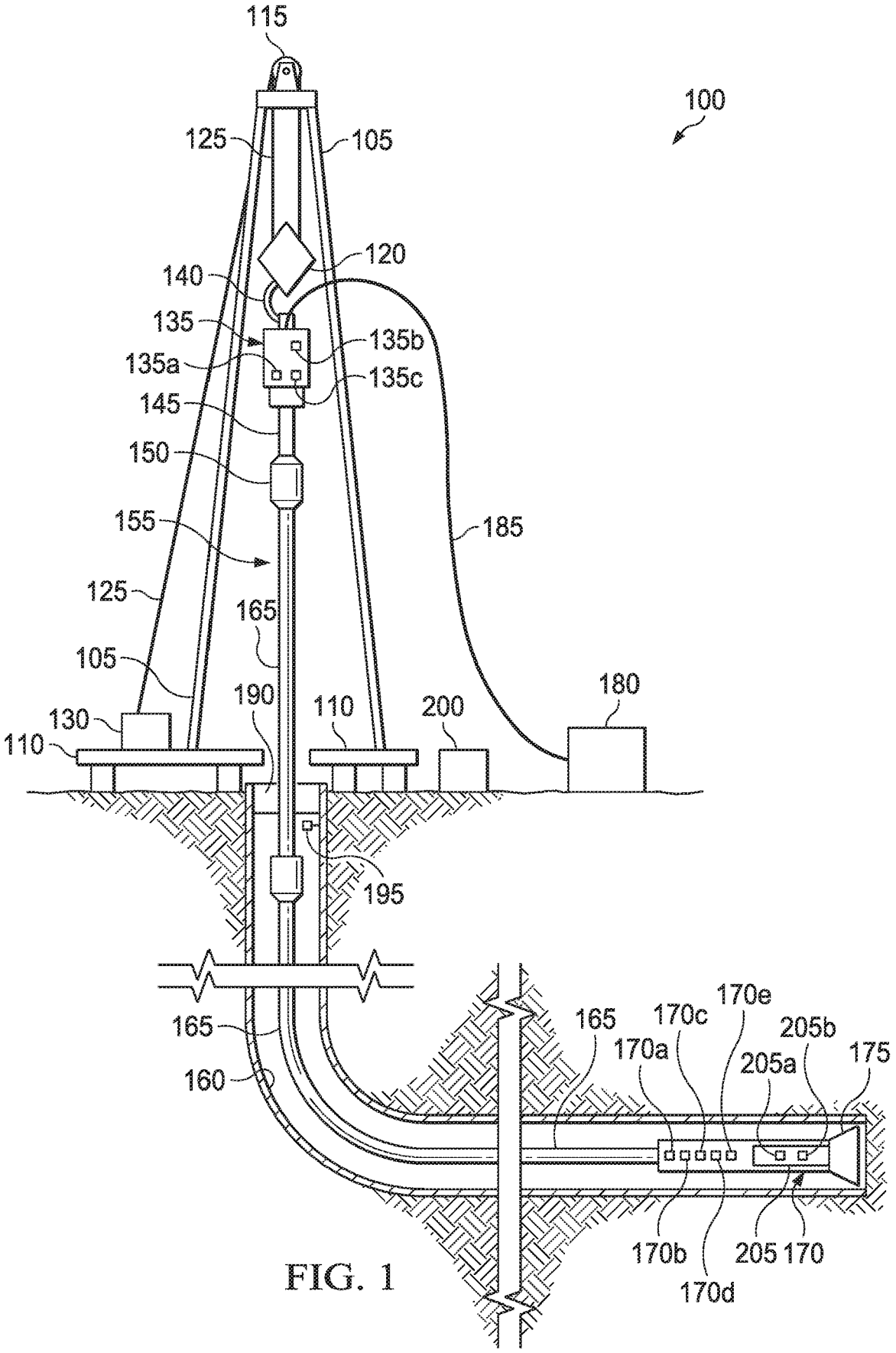
FIG. 1 is a schematic elevational view of a well system, according to one or more embodiments of the present disclosure.

In an embodiment, as illustrated in FIG. 1, a well system (e.g., a drilling rig) for implementing one or more embodiments of the present disclosure is schematically illustrated and generally referred to by the reference numeral 100. The well system 100 is or includes a land-based drilling rig—however, one or more aspects of the present disclosure are applicable or readily adaptable to any type of drilling rig (e.g., a jack-up rig, a semisubmersible, a drill ship, a coiled tubing rig, a well service rig adapted for drilling and/or re-entry operations, and a casing drilling rig, among others). The well system 100 includes a mast 105 that supports lifting gear above a rig floor 110, which lifting gear includes a crown block 115 and a traveling block 120. The crown block 115 is coupled to the mast 105 at or near the top of the mast 105. The traveling block 120 hangs from the crown block 115 by a drilling line 125. The drilling line 125 extends at one end from the lifting gear to drawworks 130, which drawworks 130 are configured to reel out and reel in the drilling line 125 to cause the traveling block 120 to be lowered and raised relative to the rig floor 110. The other end of the drilling line 125 (known as a dead line anchor) is anchored to a fixed position, possibly near the drawworks 130 (or elsewhere on the rig).

The well system 100 further includes a top drive 135, a hook 140, a quill 145, a saver sub 150, and a drill string 155. The top drive 135 is suspended from the hook 140, which hook is attached to the bottom of the traveling block 120. The quill 145 extends from the top drive 135 and is attached to a saver sub 150, which saver sub is attached to the drill string 155. The drill string 155 is thus suspended within a wellbore 160. The quill 145 may instead be attached directly to the drill string 155. The term "quill" as used herein is not limited to a component which directly extends from the top drive 135, or which is otherwise conventionally referred to as a quill 145. For example, within the scope of the present disclosure, the "quill" may additionally (or alternatively) include a main shaft, a drive shaft, an output shaft, and/or another component which transfers torque, position, and/or rotation from the top drive 135 or other rotary driving element to the drill string 155, at least indirectly. Nonetheless, albeit merely for the sake of clarity and conciseness, these components may be collectively referred to herein as the "quill."

The drill string 155 includes interconnected sections of drill pipe 165, a bottom-hole assembly ("BHA") 170, and a drill bit 175. The BHA 170 may include stabilizers, drill collars, and/or measurement-while-drilling ("MWD") or wireline conveyed instruments, among other components. The drill bit 175 is connected to the bottom of the BHA 170 or is otherwise attached to the drill string 155. One or more mud pumps 180 deliver drilling fluid to the drill string 155 through a hose or other conduit 185, which conduit may be connected to the top drive 135. The downhole MWD or wireline conveyed instruments may be configured for the evaluation of physical properties such as pressure, temperature, torque, weight-on-bit ("WOB"), vibration, inclination, azimuth, toolface orientation in three-dimensional space, and/or other downhole parameters. These measurements may be made downhole, stored in solid-state memory for some time, and downloaded from the instrument(s) at the surface and/or transmitted in real-time or delayed time to the surface. Data transmission methods may include, for example, digitally encoding data and transmitting the encoded data to the surface as pressure pulses in the drilling fluid or mud system. The MWD tools and/or other portions of the BHA 170 may have the ability to store measurements for later retrieval via wireline and/or when the BHA 170 is tripped out of the wellbore 160.

The well system 100 may also include a rotating blow-out preventer ("BOP") 190, such as if the wellbore 160 is being drilled utilizing under-balanced or managed-pressure drilling methods. In such an embodiment, the annulus mud and cuttings may be pressurized at the surface, with the actual desired flow and pressure possibly being controlled by a choke system, and the fluid and pressure being retained at the well head and directed down the flow line to the choke system by the rotating BOP 190. The well system 100 may also include a surface casing annular pressure sensor 195 configured to detect the pressure in the annulus defined between, for example, the wellbore 160 (or casing therein) and the drill string 155. In the embodiment of FIG. 1, the top drive 135 is utilized to impart rotary motion to the drill string 155. However, aspects of the present disclosure are also applicable or readily adaptable to embodiments utilizing other drive systems, such as a power swivel, a rotary table, a coiled tubing unit, a downhole motor, and/or a conventional rotary rig, among others.

The well system 100 also includes a control system 200 configured to control or assist in the control of one or more components of the well system 100—for example, the control system 200 may be configured to transmit operational control signals to the drawworks 130, the top drive 135, the BHA 170 and/or the mud pump(s) 180. The control system 200 may be a stand-alone component installed near the mast 105 and/or other components of the well system 100. In some embodiments, the control system 200 includes one or more systems located in a control room proximate the well system 100, such as the general purpose shelter often referred to as the "doghouse" serving as a combination tool shed, office, communications center, and general meeting place. The control system 200 may be configured to transmit the operational control signals to the drawworks 130, the top drive 135, the BHA 170, and/or the mud pump(s) 180 via wired or wireless transmission. The control system 200 may also be configured to receive electronic signals via wired or wireless transmission from a variety of sensors included in the well system 100, where each sensor is configured to detect an operational characteristic or parameter. The sensors from which the control system 200 is configured to receive electronic signals via wired or wireless transmission may be, include, or be part of one or more of the following: a torque sensor 135*a*, a speed sensor 135*b*, a WOB sensor 135*c*, a downhole annular pressure sensor 170*a*, a shock/vibration sensor 170*b*, a toolface sensor 170*c*, a WOB sensor 170*d*, an MWD survey tool 170*e*, the surface casing annular pressure sensor 195, a mud motor delta pressure ("ΔP") sensor 205*a*, and one or more torque sensors 205*b*.

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data. The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the wellrig site or located at another, remote location with a network link to the well system 100.

The well system 100 may include any combination of the following: the torque sensor 135*a*, the speed sensor 135*b*, and the WOB sensor 135*c*. The torque sensor 135*a* is coupled to or otherwise associated with the top drive 135—however, the torque sensor 135*a* may alternatively be part of or associated with the BHA 170. The torque sensor 135*a* is configured to detect a value (or range) of the torsion of the quill 145 and/or the drill string 155 in response to, for example, operational forces acting on the drill string 155. The speed sensor 135*b* is configured to detect a value (or range) of the rotational speed of the quill 145. The WOB sensor 135*c* is coupled to or otherwise associated with the top drive 135, the drawworks 130, the crown block 115, the traveling block 120, the drilling line 125 (which includes the dead line anchor), or another component in the load path mechanisms of the well system 100. More particularly, the WOB sensor 135*c* includes one or more sensors different from the WOB sensor 170*d* that detect and calculate weight-on-bit, which can vary from rig to rig (e.g., calculated from a hook load sensor based on active and static hook load).

Further, the well system 100 may additionally (or alternatively) include any combination of the following: the downhole annular pressure sensor 170*a*, the shock/vibration sensor 170*b*, the toolface sensor 170*c*, and the WOB sensor 170*d*. The downhole annular pressure sensor 170*a* is coupled to or otherwise associated with the BHA 170, and may be configured to detect a pressure value or range in the annulus-shaped region defined between the external surface of the BHA 170 and the internal diameter of the wellbore 160 (also referred to as the casing pressure, downhole casing pressure, MWD casing pressure, or downhole annular pressure). Such measurements may include both static annular pressure (i.e., when the mud pump(s) 180 are off) and active annular pressure (i.e., when the mud pump(s) 180 are on). The shock/vibration sensor 170*b* is configured for detecting shock and/or vibration in the BHA 170. The toolface sensor 170*c* is configured to detect the current toolface orientation of the drill bit 175, and may be or include a magnetic toolface sensor which detects toolface orientation relative to magnetic north or true north. In addition, or instead, the toolface sensor 170*c* may be or include a gravity toolface sensor which detects toolface orientation relative to the Earth's gravitational field. In addition, or instead, the toolface sensor 170*c* may be or include a gyro sensor. The WOB sensor 170*d* may be integral to the BHA 170 and is configured to detect WOB at or near the BHA 170.

Further still, the well system 100 may additionally (or alternatively) include the MWD survey tool 170*e* at or near the BHA 170. In some embodiments, the MWD survey tool 170*e* may include any of the sensors 170*a*-170*d* or any combination of these sensors. The BHA 170 and the MWD portion of the BHA 170 (which portion includes the sensors 170*a-d* and the MWD survey tool 170*e*) may be collectively referred to as a "downhole tool." Alternatively, the BHA 170 and the MWD portion of the BHA 170 may each be individually referred to as a "downhole tool." The MWD survey tool 170*e* may be configured to perform surveys along lengths of a wellbore, such as during drilling and tripping operations. The data from these surveys may be transmitted by the MWD survey tool 170*e* to the control system 200 through various telemetry methods, such as mud pulses. In addition, or instead, the data from the surveys may be stored within the MWD survey tool 170*e* or an associated memory. In such embodiments, the survey data may be downloaded to the control system 200 when the MWD survey tool 170*e* is removed from the wellbore or at a maintenance facility at a later time.

Finally, the well system 100 may additionally (or alternatively) include any combination of the following: the mud motor ΔP sensor 205*a* and the torque sensor(s) 205*b*. The mud motor ΔP sensor 205*a* is configured to detect a pressure differential value or range across one or more motors 205 of the BHA 170 and may comprise one or more individual pressure sensors and/or a comparison tool. The motor(s) 205 may each be or include a positive displacement drilling motor that uses hydraulic power of the drilling fluid to drive the drill bit 175 (also known as a mud motor). The torque sensor(s) 205*b* may also be included in the BHA 170 for sending data to the control system 200 that is indicative of the torque applied to the drill bit 175 by the motor(s) 205.

Figure 2:
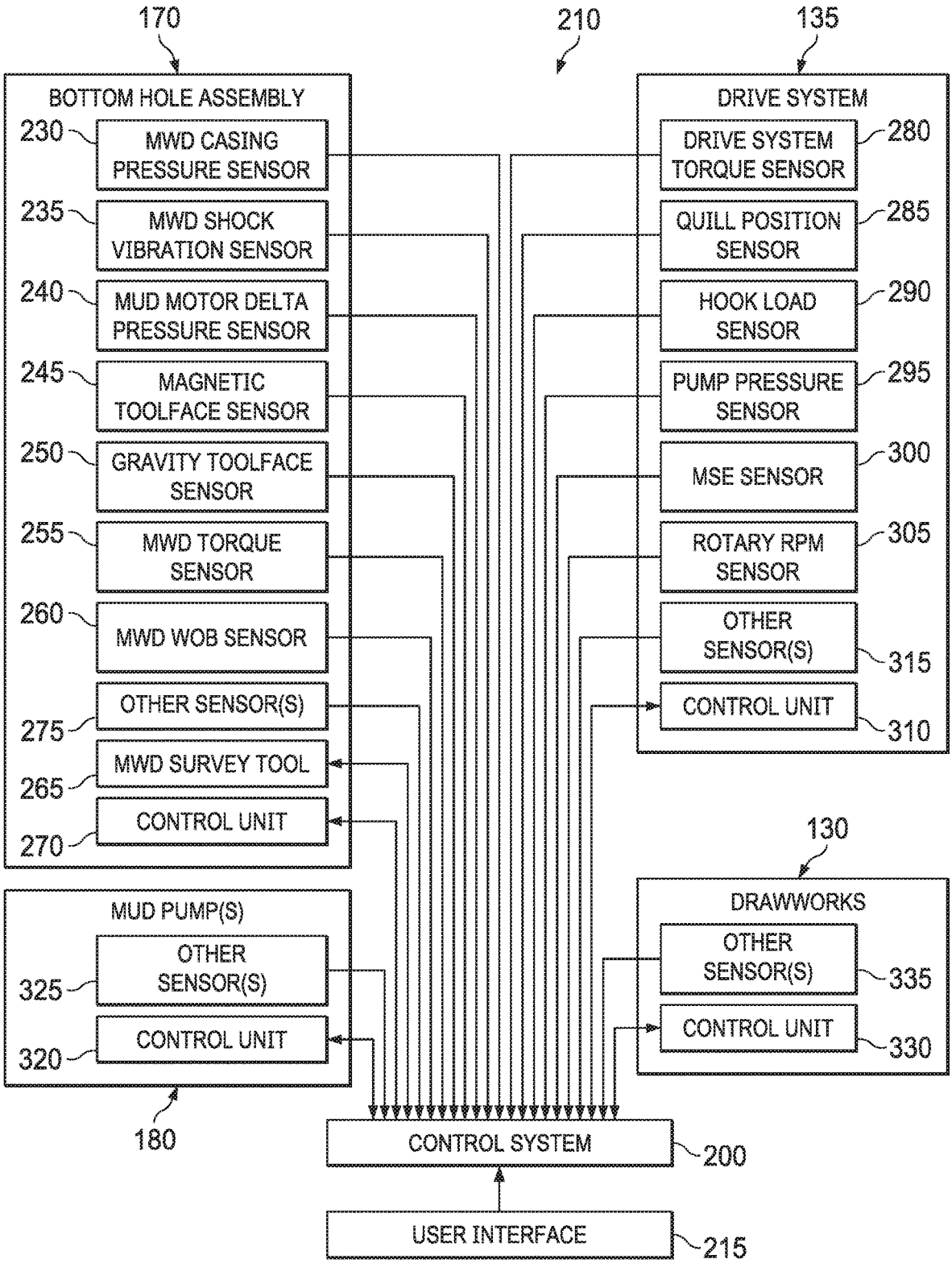
FIG. 2 is a diagrammatic view of a well system that may be, include, or be part of the well system of FIG. 1, according to one or more embodiments of the present disclosure.

In an embodiment, as illustrated in FIG. 2, a well system is generally referred to by the reference numeral 210 and includes one or more components of the well system 100. More particularly, the well system 210 may include at least respective parts of the well system 100, including, but not limited to, the control system 200, the drawworks 130, the top drive 135 (identified as a "drive system" in FIG. 2), the BHA 170, and the mud pump(s) 180. The well system 210 may be implemented within the environment and/or the well system 100 of FIG. 1. As such, the well system 100 and/or the well system 210 may be individually or collectively referred to as a "well system," a "drilling system," a "drilling rig," or the like. As shown in FIG. 2, the control system 200 includes a user-interface 215 adapted to communicate therewith—depending on the embodiment, the control system 200 and the user-interface 215 may be discrete components that are interconnected via a wired or wireless link. The user-interface 215 and the control system 200 may additionally (or alternatively) be integral components of a single system.

Figure 3:
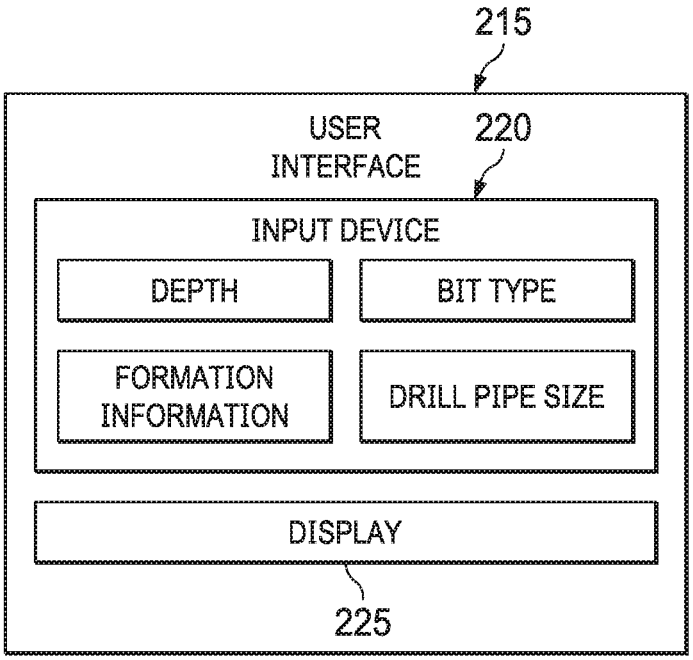
FIG. 3 is a diagrammatic view of a user interface of the well system of FIG. 2, according to one or more embodiments of the present disclosure.

Turning to FIG. 3, in one or more embodiments the user-interface 215 may include an input mechanism 220 that permits a user to input drilling settings or parameters such as, for example, left and right oscillation revolution settings (these settings control the drive system to oscillate a portion of the drill string 155), acceleration, toolface setpoints, rotation settings, a torque target value (such as a previously calculated torque target value that may determine the limits of oscillation), information relating to the drilling parameters of the drill string 155 (such as BHA information or arrangement, drill pipe size, bit type, depth, and formation information), and/or other setpoints and input data. The input mechanism 220 may include a keypad, voice-recognition apparatus, dial, button, switch, slide selector, toggle, joystick, mouse, database, and/or any other suitable data input device. The input mechanism 220 may support data input from local and/or remote locations. In addition, or instead, the input mechanism 220, when included, may permit user-selection of predetermined profiles, algorithms, setpoint values or ranges, such as via one or more drop-down menus—this data may instead (or in addition) be selected by the control system 200 via the execution of one or more database look-up procedures. In general, the input mechanism 220 and/or other components within the scope of the present disclosure support operation and/or monitoring from stations on the rig site as well as one or more remote locations with a communications link to the system, network, local area network ("LAN"), wide area network ("WAN"), Internet, satellite-link, and/or radio, among other suitable techniques or systems. The user-interface 215 may also include a display 225 for visually presenting information to the user in textual, graphic, or video form. The display 225 may be utilized by the user to input drilling parameters, limits, or setpoint data in conjunction with the input mechanism 220—for example, the input mechanism 220 may be integral to or otherwise communicably coupled with the display 225. The control system 200 may be configured to receive data or information from the user, the drawworks 130, the top drive 135, the BHA 170, and/or the mud pump(s) 180—the control system 200 processes such data or information to enable effective and efficient drilling.

Turning back to FIG. 2, in one or more embodiments the BHA 170 includes one or more sensors (typically a plurality of sensors) located and configured about the BHA 170 to detect parameters relating to the drilling environment, the condition and orientation of the BHA 170, and/or other information. For example, the BHA 170 may include an MWD casing pressure sensor 230, an MWD shock/vibration sensor 235, a mud motor ΔP sensor 240, a magnetic toolface sensor 245, a gravity toolface sensor 250, an MWD torque sensor 255, and an MWD weight-on-bit ("WOB") sensor 260—in some embodiments, one or more of these sensors is, includes, or is part of the following sensor(s) shown in FIG. 1: the downhole annular pressure sensor 170*a*, the shock/vibration sensor 170*b*, the toolface sensor 170*c*, the WOB sensor 170*d*, the mud motor ΔP sensor 205*a*, and/or the torque sensor(s) 205*b*.

The MWD casing pressure sensor 230 is configured to detect an annular pressure value or range at or near the MWD portion of the BHA 170. The MWD shock/vibration sensor 235 is configured to detect shock and/or vibration in the MWD portion of the BHA 170. The mud motor ΔP sensor 240 is configured to detect a pressure differential value or range across the mud motor of the BHA 170. The magnetic toolface sensor 245 and the gravity toolface sensor 250 are cooperatively configured to detect the current toolface orientation. In some embodiments, the magnetic toolface sensor 245 is or includes a magnetic toolface sensor that detects toolface orientation relative to magnetic north or true north. In some embodiments, the gravity toolface sensor 250 is or includes a gravity toolface sensor that detects toolface orientation relative to the Earth's gravitational field. In some embodiments, the magnetic toolface sensor 245 detects the current toolface when the end of the wellbore 160 is less than about 7° from vertical, and the gravity toolface sensor 250 detects the current toolface when the end of the wellbore 160 is greater than about 7° from vertical. Other toolface sensors may also be utilized within the scope of the present disclosure that may be more or less precise (or have the same degree of precision), including non-magnetic toolface sensors and non-gravitational inclination sensors. The MWD torque sensor 255 is configured to detect a value or range of values for torque applied to the bit by the motor(s) of the BHA 170. The MWD weight-on-bit ("WOB") sensor 260 is configured to detect a value (or range of values) for WOB at or near the BHA 170.

The following data may be sent to the control system 200 via one or more signals, such as, for example, electronic signal via wired or wireless transmission, mud-pulse telemetry, another signal, or any combination thereof: the casing pressure data detected by the MWD casing pressure sensor 230, the shock/vibration data detected by the MWD shock/vibration sensor 235, the pressure differential data detected by the mud motor ΔP sensor 240, the toolface orientation data detected by the toolface sensors 245 and 250, the torque data detected by the MWD torque sensor 255, and/or the WOB data detected by the MWD WOB sensor 260. The pressure differential data detected by the mud motor ΔP sensor 240 may alternatively (or additionally) be calculated, detected, or otherwise determined at the surface, such as by calculating the difference between the surface standpipe pressure just off-bottom and the pressure measured once the bit touches bottom and starts drilling and experiencing torque.

The BHA 170 may also include an MWD survey tool 265—in some embodiments, the MWD survey tool 265 is, includes, or is part of the MWD survey tool 170*e* shown in FIG. 1. The MWD survey tool 265 may be configured to perform surveys at intervals along the wellbore 160, such as during drilling and tripping operations. The MWD survey tool 265 may include one or more gamma ray sensors that detect gamma data. The data from these surveys may be transmitted by the MWD survey tool 265 to the control system 200 through various telemetry methods, such as mud pulses. In other embodiments, survey data is collected and stored by the MWD survey tool 265 in an associated memory. This data may be uploaded to the control system 200 at a later time, such as when the MWD survey tool 265 is removed from the wellbore 160 or during maintenance. Some embodiments use alternative data gathering sensors or obtain information from other sources. For example, the BHA 170 may include sensors for making additional measurements, including, for example and without limitation, azimuthal gamma data, neutron density, porosity, and resistivity of surrounding formations. In some embodiments, such information may be obtained from third parties or may be measured by systems other than the BHA 170.

The BHA 170 may include a memory and a transmitter. In some embodiments, the memory and transmitter are integral parts of the MWD survey tool 265, while in other embodiments, the memory and transmitter are separate and distinct modules. The memory may be any type of memory device, such as a cache memory (e.g., a cache memory of the processor), random access memory (RAM), magnetoresistive RAM (MRAM), read-only memory (ROM), programmable read-only memory (PROM), erasable programmable read only memory (EPROM), electrically erasable programmable read only memory (EEPROM), flash memory, solid state memory device, hard disk drives, or other forms of volatile and non-volatile memory. The memory may be configured to store readings and measurements for some period of time. In some embodiments, the memory is configured to store the results of surveys performed by the MWD survey tool 265 for some period of time, such as the time between drilling connections, or until the memory may be downloaded after a tripping out operation. The transmitter may be any type of device to transmit data from the BHA 170 to the control system 200, and may include a mud pulse transmitter. In some embodiments, the MWD survey tool 265 is configured to transmit survey results in real-time to the surface through the transmitter. In other embodiments, the MWD survey tool 265 is configured to store survey results in the memory for a period of time, access the survey results from the memory, and transmit the results to the control system 200 through the transmitter.

In some embodiments, the BHA 170 also includes a control unit 270 for controlling the rotational position, speed, and direction of the rotary drilling bit or toolface. The control unit 270 may be, include, or be part of the control system 200, or another control system. The BHA 170 may also include other sensor(s) 275 such as, for example, other MWD sensors, other LWD sensors, other downhole sensors, back-upredundant sensors, one or more sensors repurposed, repositioned, or reproduced from one or more of the top drive 135, the drawworks 130, and/or the mud pump(s) 180, and/or or any combination thereof.

The top drive 135 includes one or more sensors (typically a plurality of sensors) located and configured about the top drive 135 to detect parameters relating to the condition and orientation of the drill string 155, and/or other information. For example, the top drive 135 may include a rotary torque sensor 280, a quill position sensor 285, a hook load sensor 290, a pump pressure sensor 295, a mechanical specific energy ("MSE") sensor 300, and a rotary RPM sensor 305—in some embodiments, one or more of these sensors is, includes, or is part of the following sensor(s) shown in FIG. 1: the torque sensor 135*a*, the speed sensor 135*b*, the WOB sensor 135*c*, and/or the casing annular pressure sensor 195. In addition to, or instead of, being included as part of the drive system 135, the pump pressure sensor 295 may be included as part of the mud pump(s) 180. In some embodiments, the top drive 135 also includes a control unit 310 for controlling the rotational position, speed, and direction of the quill 145 and/or another component of the drill string 155 coupled to the top drive 135. The control unit 310 may be, include, or be part of the control system 200, or another control system. The top drive 135 may also include other sensor(s) 315 such as, for example, other top drive sensors, other surface sensors, back-upredundant sensors, one or more sensors repurposed, repositioned, or reproduced from one or more of the BHA 170, the drawworks 130, and/or the mud pump(s) 180, and/or or any combination thereof.

The rotary torque sensor 280 is configured to detect a value (or range of values) for the reactive torsion of the quill 145 or the drill string 155. The quill position sensor 285 is configured to detect a value (or range of values) for the rotational position of the quill 145 (e.g., relative to true north or another stationary reference). The hook load sensor 290 is configured to detect the load on the hook 140 as it suspends the top drive 135 and the drill string 155. The pump pressure sensor 295 is configured to detect the pressure of the mud pump(s) 180 providing mud or otherwise powering the BHA 170 from the surface. In some embodiments, rather than being included as part of the top drive 135, the pump pressure sensor 295 may be incorporated into, or included as part of, the mud pump(s) 180. The MSE sensor 300 is configured to detect the MSE representing the amount of energy required per unit volume of drilled rock—in some embodiments, the MSE is not directly detected, but is instead calculated at the control system 200 (or another control system or control unit) based on sensed data. The rotary RPM sensor 305 is configured to detect the rotary RPM of the drill string 155—this may be measured at the top drive 135 or elsewhere (e.g., at surface portion of the drill string 155). The following data may be sent to the control system 200 via one or more signals, such as, for example, electronic signal via wired or wireless transmission: the rotary torque data detected by the rotary torque sensor 280, the quill position data detected by the quill position sensor 285, the hook load data detected by the hook load sensor 290, the pump pressure data detected by the pump pressure sensor 295, the MSE data detected (or calculated) by the MSE sensor 300, and/or the RPM data detected by the RPM sensor 305.

The mud pump(s) 180 may include a control unit 320 and/or other means for controlling the pressure and flow rate of the drilling mud produced by the mud pump(s) 180—such control may include torque and speed control of the mud pump(s) 180 to manipulate the pressure and flow rate of the drilling mud and the ramp-up or ramp-down rates of the mud pump(s) 180. In some embodiments, the control unit 320 is, includes, or is part of the control system 200. The mud pump(s) 180 may also include other sensor(s) 325 such as, for example, the pump pressure sensor 295, one or more pump flow sensors, other mud pump sensors, other surface sensors, back-upredundant sensors, one or more sensors repurposed, repositioned, or reproduced from one or more of the BHA 170, the top drive 135, and/or the drawworks 130, and/or or any combination thereof.

The drawworks 130 may include a control unit 330 and/or other means for controlling feed-out and/or feed-in of the drilling line 125 (shown in FIG. 1)—such control may include rotational control of the drawworks to manipulate the height or position of the hook and the rate at which the hook ascends or descends. The drill string feed-off system of the drawworks 130 may instead be a hydraulic ram or rack and pinion type hoisting system rig, where the movement of the drill string 155 up and down is facilitated by something other than a drawworks. The drill string 155 may also take the form of coiled tubing, in which case the movement of the drill string 155 in and out of the wellbore 160 is controlled by an injector head which grips and pushes/pulls the tubing in/out of the wellbore 160. Such embodiments still include a version of the control unit 330 configured to control feed-out and/or feed-in of the drill string 155. In some embodiments, the control unit 330 is, includes, or is part of the control system 200. The drawworks 130 may also include other sensor(s) 335 such as, for example, other drawworks sensors, other surface sensors, back-upredundant sensors, one or more sensors repurposed, repositioned, or reproduced from one or more of the BHA 170, the top drive 135, and/or the drawworks 130, and/or or any combination thereof.

The control system 200 may be configured to receive data or information relating to one or more of the above-described parameters from the user-interface 215, the BHA 170 (including the MWD survey tool 265), the top drive 135, the mud pump(s) 180, and/or the drawworks 130, as described above, and to utilize such information to enable effective and efficient drilling. In some embodiments, the parameters are transmitted to the control system 200 by one or more data channels. In some embodiments, each data channel may carry data or information relating to a particular sensor or combination of sensors. The control system 200 may be further configured to generate a control signal, such as via intelligent adaptive control, and provide the control signal to the top drive 135, the mud pump(s) 180, the drawworks 130, and/or the BHA 170 to adjust and/or maintain one or more of the following: the rotational position, speed, and direction of the quill 145 and/or another component of the drill string 155 coupled to the top drive 135, the pressure and flow rate of the drilling mud produced by the mud pump(s) 180, the feed-out and/or feed-in of the drilling line 125, and/or the rotational position, speed, and direction of the rotary drilling bit or toolface. Moreover, one or more of the control unit 270 of the BHA 170 the control unit 310 of the top drive 135, the control unit 320 of the mud pump(s) 180, and/or the control unit 330 of the drawworks 130 may be configured to generate and transmit signals to the control system 200—these signals influence the control of the BHA 170, the top drive 135, the mud pump(s) 180, and/or the drawworks 130. In addition, or instead, any one of the control units 270, 310, 320, and 330 may be configured to generate and transmit signals to another one of the control units 270, 310, 320, or 330, whether directly or via the control system 200—as a result, any combination of the control units 270, 310, 320, and 330 may be configured to cooperate in controlling the BHA 170, the top drive 135, the mud pump(s) 180, and/or the drawworks 130.

Figure 4:
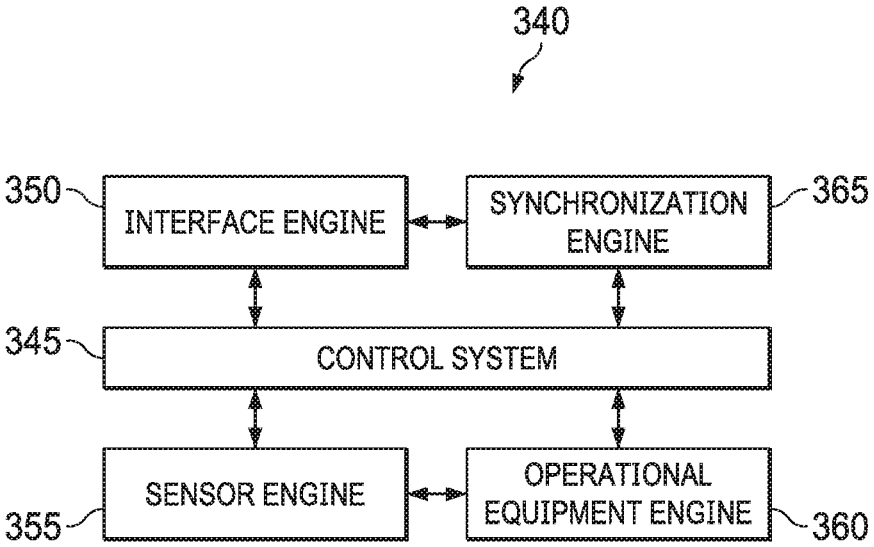
FIG. 4 is a diagrammatic view of a well system that may be, include, or be part of the well system of FIG. 1 and/or the well system of FIG. 2, according to one or more embodiments of the present disclosure.

In an embodiment, as illustrated in FIG. 4, a well system is generally referred to by the reference numeral 340 and includes one or more components of the well system 100 and/or the well system 210. More particularly, the well system 340 may include at least respective parts of the well system 100 and/or the well system 210, including, but not limited to, the control system 200, the drawworks 130, the top drive 135, the BHA 170, and the mud pump(s) 180. The well system 340 may be implemented within the environment and/or the well system 100 of FIG. 1, and/or within the environment and/or the well system 210 of FIG. 2. As such, the well system 100, the well system 210, and/or the well system 340 may be individually or collectively referred to as a "well system," a "drilling system," a "drilling rig," or the like. The well system includes a control system 345. In some embodiments, the control system 345 is, includes, or is part of the control system 200 shown in FIGS. 1 and 2. As a result, the control system 345 may include a combination (or sub-combination) of the control units 270, 310, 320, and 330. The control system 345 is coupled to, and adapted to communicate with, an interface engine 350, a sensor engine 355, an operational equipment engine 360, and a synchronization engine 365. The interface engine 350 is operably coupled to, and adapted to communicate with, the synchronization engine 365. The sensor engine 355 is operably coupled to, and adapted to communicate with, the operational equipment engine 360. The control system 345 may include or be part of one, or any combination, of the interface engine 350, the sensor engine 355, the operational equipment engine 360, and/or the synchronization engine 365.

The term "engine" is meant herein to refer to an agent, instrument, or combination of either, or both, agents and instruments that may be associated to serve a purpose or accomplish a task—agents and instruments may include sensors, actuators, switches, relays, valves, power plants, system wiring, equipment linkages, specialized operational equipment, computers, components of computers, programmable logic devices, microprocessors, software, software routines, software modules, communication equipment, networks, network services, and/or other elements and their equivalents that contribute to the purpose or task to be accomplished by the engine. Accordingly, some of the engines may be software modules or routines, while others of the engines may be hardware and/or equipment elements in communication with the control system 345. The control system 345 operates to control the interaction of data with and between the other components of the well system 340.

The interface engine 350 includes at least one input and output device or system that enables a user to interact with the control system 345 and the functions that the control system 345 provides. In some embodiments, the interface engine 350 includes at least the following component: the user-interface 215 (shown in FIGS. 2 and 3). However, the interface engine 350 may have multiple user stations, which may include a video display, a keyboard, a pointing device, a document scanning/recognition device, or other device configured to receive an input from an external source, which may be connected to a software process operating as part of a computer or local area network. The interface engine 350 may include externally positioned equipment configured to input data into the control system 345. Data entry may be accomplished through various forms, including raw data entry, data transfer, or document scanning coupled with a character recognition process, for example. The interface engine 350 may include a user station that has a display with touch-screen functionality, so that a user may receive information from the well system 340, and provide input to the well system 340 directly via the display or touch screen. Other examples of sub-components that may be part of the interface engine 350 include, but are not limited to, audible alarms, visual alerts, telecommunications equipment, and computer-related components, peripherals, and systems.

Sub-components of the interface engine 350 may be positioned in various locations within an area of operation, such as on a drilling rig at a drill site. Sub-components of the interface engine 350 may also be remotely located away from the general area of operation, for example, at a business office, at a sub-contractor's office, in an operations manager's mobile phone, and in a sub-contractor's communication linked personal data appliance. A wide variety of technologies would be suitable for providing coupling of various sub-components of the interface engine 350 and the interface engine 350 itself to the control system 345. In some embodiments, the operator may thus be remote from the interface engine 350, such as through a wireless or wired internet connection, or a portion of the interface engine 350 may be remote from the rig, or even the wellsite, and be proximate a remote operator, and the portion thus connected through, e.g., an internet connection, to the remainder of the on-site components of the interface engine 350.

The sensor engine 355 may include devices such as sensors, meters, detectors, or other devices configured to measure or sense a parameter related to a component of a well drilling operation—in some embodiments, the sensor engine 355 includes one or more of the following components (shown in FIGS. 1 and 2), among others: the torque sensor 135*a*, the speed sensor 135*b*, the WOB sensor 135*c*, the downhole annular pressure sensor 170*a*, the shock/vibration sensor 170*b*, the toolface sensor 170*c*, the WOB sensor 170*d*, the MWD survey tool 170*e*, the surface casing annular pressure sensor 195, the mud motor ΔP sensor 205*a*, the torque sensor(s) 205*b*, the MWD casing pressure sensor 230, the MWD shock/vibration sensor 235, the mud motor ΔP sensor 240, the magnetic toolface sensor 245, the gravity toolface sensor 250, the MWD torque sensor 255, the MWD WOB sensor 260, the MWD survey tool 265, the other sensor(s) 275, the rotary torque sensor 280, the quill position sensor 285, the hook load sensor 290, the pump pressure sensor 295, the MSE sensor 300, and the rotary RPM sensor 305, the other sensor(s) 315, the other sensor(s) 325, and the other sensor(s) 335. The sensors or other detection devices are generally configured to sense or detect activity, conditions, and circumstances in an area to which the device has access. These sensors may be located on the surface or downhole, and configured to transmit information to the surface through a variety of methods.

Sub-components of the sensor engine 355 may be deployed at any operational area where information on the execution of one or more drilling operations may occur. Readings from the sensor engine 355 are fed back to the control system 345. The reported data may include the sensed data, or may be derived, calculated, or inferred from sensed data. Sensed data may be that concurrently collected, recently collected, or historically collected, at that wellsite or an adjacent wellsite. The control system 345 may send signals to the sensor engine 355 to adjust the calibration or operational parameters in accordance with a control program in the control system 345, which control program is generally based upon the objectives set forth in the well plan. Additionally, the control system 345 may generate outputs that control the well drilling operation, as will be described in further detail below. The control system 345 receives and processes data from the sensor engine 355 or from other suitable source(s), and monitors the rig and conditions on the rig based on the received data.

The operational equipment engine 360 may include a plurality of devices configured to facilitate accomplishment of the objectives set forth in the well plan—in some embodiments, the operational equipment engine 360 includes one or more components of FIG. 1's well system 100 and/or FIG. 2's well system 210. For example, the operational equipment engine 360 may include the drawworks 130, the top drive 135, the BHA 170, the mud pump(s) 180, and/or the control system 200. The objective of the operational equipment engine 360 is to drill a well in accordance with the specifications set forth in the well plan. Therefore, the operational equipment engine 360 may include hydraulic rams, rotary drives, valves, solenoids, agitators, drives for motors and pumps, control systems, and any other tools, machines, equipment, or the like that would be required to drill the well in accordance with the well plan. The operational equipment engine 360 may be designed to exchange communication with control system 345, so as to not only receive instructions, but to provide information on the operation of the operational equipment engine 360 apart from any associated sensor engine 355. For example, encoders associated with the top drive 135 may provide rotational information regarding the drill string 165, and hydraulic links may provide height, positional information, or a change in height or positional information. The operational equipment engine 360 may be configured to receive control inputs from the control system 345 and to control the well drilling operation (i.e., the components conducting the well drilling operation) in accordance with the received inputs from the control system 345.

The control system 345, the interface engine 350, the sensor engine 355, and the operational equipment engine 360 should be fully integrated with the well plan to assure proper operation and safety. Moreover, measurements of the rig operating parameters (block position, hook load, pump pressure, slips set, etc.) should have a high level of accuracy to enable proper accomplishment of the well plan with minimal or no human intervention once the operational parameters are selected and the control limits are set for a given drilling operation, and the trigger(s) are pre-set to initiate the operation.

Figure 5:
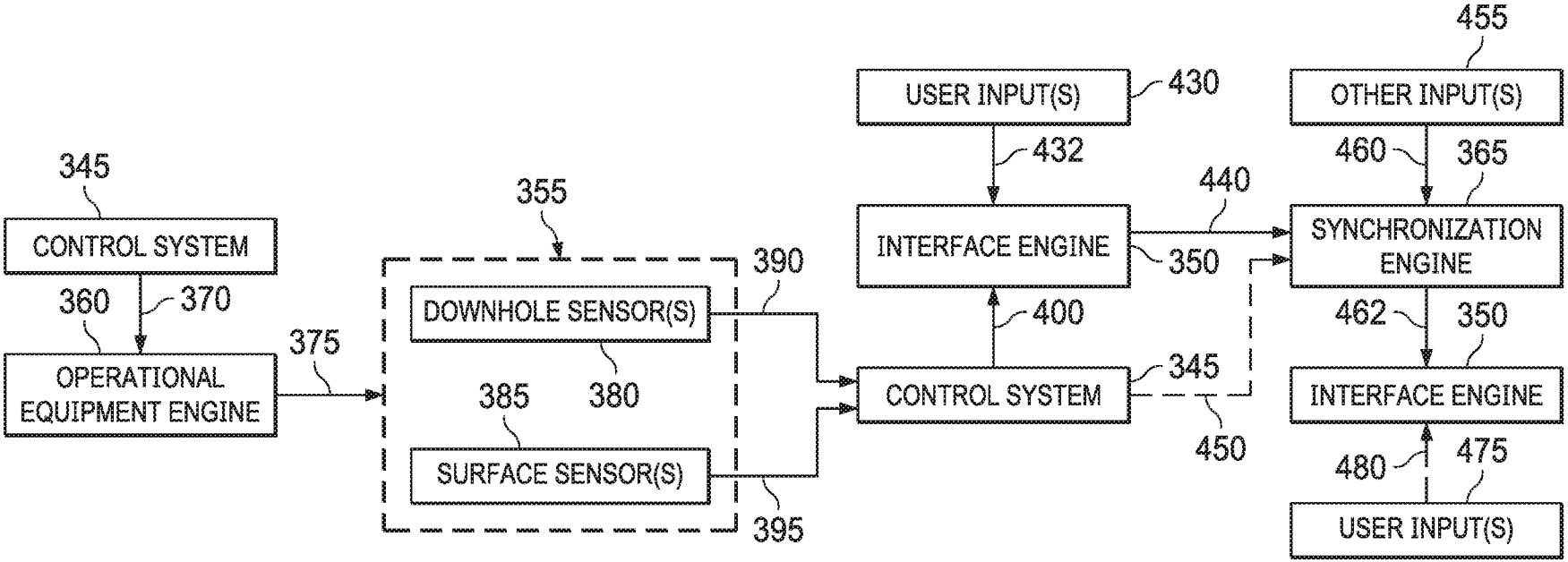
FIG. 5 is a diagrammatic view of the well system of FIGS. 1, 2, and/or 4 in operation, according to one or more embodiments of the present disclosure.

In operation, as illustrated in FIG. 5 with continuing reference to FIGS. 1-4, the control system 345 is adapted to send control signals to the operational equipment engine 360, as indicated by arrow 370. Based on the control signals, the operational equipment engine 360 is adapted to execute the well plan to drill a segment of the wellbore 160. During the drilling of the well segment by the operational equipment engine 360, the sensor engine 355 is adapted to monitor various components and/or operational parameters of the operational equipment engine 360, as indicated by arrow 375. More particularly, in some embodiments, the sensor engine 355 is adapted to detect first and second drilling conditions associated with the operational equipment engine 360. The first and second drilling conditions may be detected by separate sensors, and may be either different drilling conditions or the same drilling condition. In at least one such embodiment, as shown in FIG. 5, one of the first and second sensors may be a downhole sensor 380 and the other of the first and second sensors may be a surface sensor 385. The downhole sensor 380 is adapted to send a first data stream to the control system 345, as indicated by the arrow 390. The first data stream is based on the detected first drilling condition over a time interval (e.g., differential pressure, RPMs, etc.). The surface sensor 385 is adapted to send a second data stream to the control system 345, as indicated by arrow 395. The second data stream is based on the second detected drilling condition over the time interval (e.g., weight-on-bit, RPMs, etc.).

In some instances, one or more of the downhole sensor(s) 380 may include internal clock(s) operable to associate a time measured by the internal clock(s) when a measurement is taken with the raw data of the measurement itself before sending both to the control system 345 (either continuously or intermittently). Similarly, one or more of the surface sensor(s) 385 may include internal clock(s) operable to associate a time measured by the internal clock(s) when a measurement is taken with the raw data of the measurement itself before sending both to the control system 345 (either continuously or intermittently). As a result, measurements sent to the control system 345 from the downhole sensor(s) 380 include times measured by the internal clock(s) of said downhole sensor(s) 380 when the measurements were taken, and measurements sent to the control system 345 from the surface sensor(s) 385 include times measured by the internal clock(s) of said surface sensor(s) 385 when the measurements were taken. In one embodiment, there is no clock or time tracking at all on one or more measurements, and measurements sent to the control system 345 from different sources including one or more downhole sensors(s) 380 can be matched according to the disclosure herein, e.g., visually by an operator or by the control system fitting datapoints from separate inputs on a best-fit curve.

Although described as being sent from the downhole sensor 380 and the surface sensor 385, respectively, the first and second data streams may instead be sent from any pair of sensors described herein. Accordingly, the first and second data streams may be sent from a pair of surface sensors, a pair of downhole sensors, or a downhole sensor and a surface sensor, respectively (as described above). For example, the first drilling condition may be WOB detected by the WOB sensor 135*c* and/or the hook load sensor 290, and the second drilling condition may be weight-on-bit detected by the WOB sensor 170*d* and/or the MWD WOB sensor 260. For another example, the first drilling condition may be hook load detected by the WOB sensor 135*c* and/or the hook load sensor 290, and the second drilling condition may be differential pressure detected by the mud motor ΔP sensor 205*a*, and/or the mud motor ΔP sensor 240. For yet another example, the first drilling condition may be RPMs detected by one or more of the downhole sensor(s) 380, and the second drilling condition may be RPMs detected by one or more of the surface sensor(s) 385 (e.g., the rotary RPM sensor 305 or the speed sensor 135*b*). In some embodiments, although the values measured by the one or more downhole sensor(s) 380 will not be the same as those measured by the one or more surface sensor(s) 385, the first and second data streams will each have patterns that can be correlated with one another to determine whether any "clock drift" has occurred between internal clock(s) of the downhole sensor(s) 380 and internal clock(s) of the surface sensor(s) 385.

Figure 6:
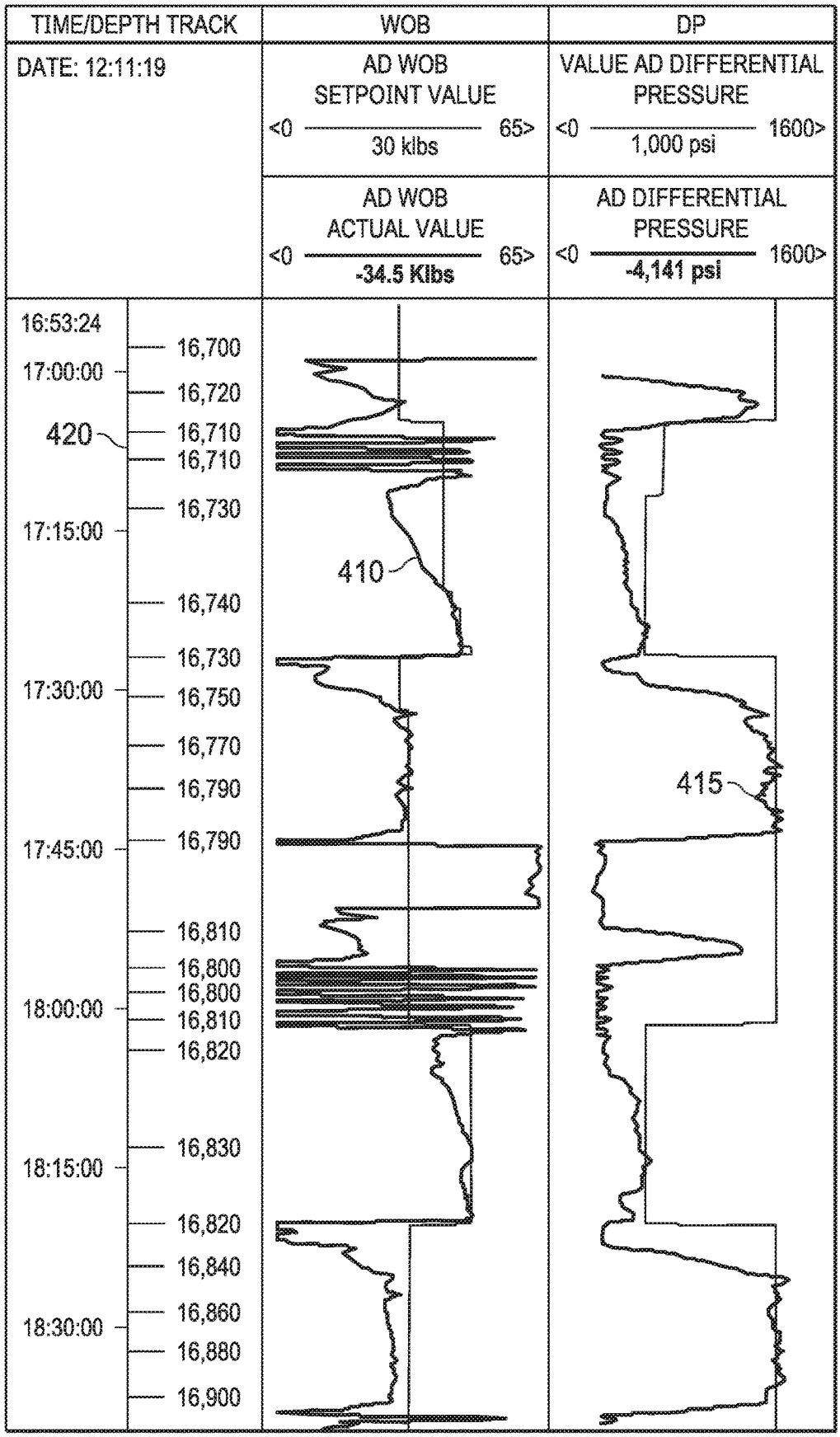
FIG. 6 is a graphical view of a user interface displayed during at least a portion of the well system operation shown in FIG. 5, according to one or more embodiments of the present disclosure.

In some embodiments, the first and second data streams are then sent to the interface engine 350 and displayed to a user, as indicated by arrow 400. An example graphical user interface 405 generated as a result of the first and second data streams being sent to the interface engine 350 is illustrated in FIG. 6. As shown in FIG. 6, the first and second data streams are generally referred to by the reference numerals 410 and 415, respectively, and may be displayed adjacent one another against a time axis 420 (and/or a depth axis). In some embodiments, the first and second data streams 410 and 415 are displayed in their "raw" form in the graphical user interface 405; that is, the first and second data streams 410 and 415 are displayed against the time axis 420 without any "clock drift" correction applied. In some instances, the first and second data streams 410 and 415 may be received from the sensor engine 355 asynchronously, that is, in such a manner that respective time intervals over which the first and second data streams 410 and 415 are received by the control system 345 do not accurately correspond to the actual time interval over which the first and second data streams were detected by the sensor engine 355. Furthermore, as discussed above the sensors responsible for detecting the drilling conditions on which the first and second data streams 410 and 415 are based may have internal clock(s) that experience substantial "clock drift" relative to one another. As a result, the first and second data streams sent to the control system 345 are associated with times measured by the respective internal clock(s) of the sensors that detect the first and second data streams. Thus, if the respective internal clock(s) of these sensors are not synchronous, there may be a substantial misalignment of the first and second data streams 410 and 415 along the time axis 420 relative to the actual time interval over which the first and second data streams 410 and 415 were detected—this misalignment is shown in FIG. 7A and referred to by the reference numeral 425.

Figure 7A:
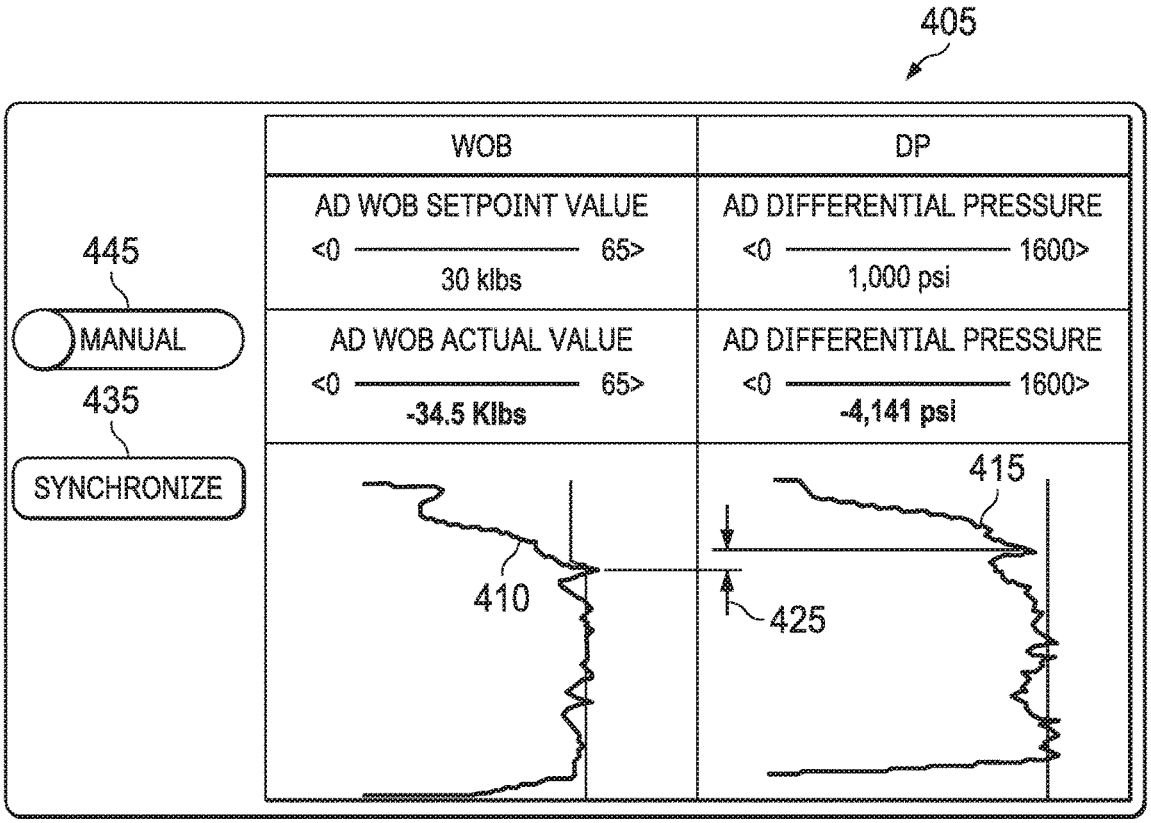
FIG. 7A is an enlarged version of the graphical view of FIG. 6, according to one or more embodiments of the present disclosure.

For example, as shown in FIG. 7A, in some instances, the first data stream 410 may be weight-on-bit and the second data stream 415 may be differential pressure. A user might normally expect an increase in weight-on-bit to cause an immediate corresponding increase in differential pressure, and vice versa. Based on this knowledge, the user may recognize the misalignment 425 along the time axis 420 between corresponding characteristics (e.g., peaks) of the first and second data streams 410 and 415 associated with, for example, an increase in weight-on-bit and an increase in differential pressure. Upon recognizing the misalignment 425, the user may provide user input(s) 430 via the interface engine 350, as indicated by arrow 432 in FIG. 5. For example, the user input(s) 430 may include the pressing of a "synchronize" button 435 of the graphical user interface 405 that, when pressed, signals the interface engine 350 to send the first and second data streams to the synchronization engine 365 for synchronization, as indicated by arrow 440 in FIG. 5. In addition, or instead, the user input(s) 430 may include a "manual/automatic" radio button 445 that allows the user to choose between a manual mode and an automatic mode. For example, in the manual mode, the user manually recognizes misalignment(s) between characteristics of a pair (or more) of data streams and presses the "synchronize" button 435 of the graphical user interface 405 to signal the synchronization engine 365 to synchronize the first and second data streams 410 and 415. In contrast, in the automatic mode, the control system 345 bypasses the interface engine 350 and instead sends the first and second data streams 410 and 415 directly to the synchronization engine 365, as indicated by arrow 450 in FIG. 5.

In any case, the synchronization engine 365 determines, based on a relationship between the first and second drilling conditions, whether the first and second data streams 410 and 415 are asynchronous with each other and relative to the time interval over which the first and second data streams were detected by the sensor engine 355. This determination may be based at least in part on other input(s) 455 provided to the synchronization engine 365, as indicated by arrow 460. Such other input(s) 455 may include, but are not limited to, previously known and/or calculated relationships between various drilling conditions, including at least the first and second drilling conditions. In addition, or instead, this determination may be based on machine learning and/or signal pattern recognition that recognizes data stream(s) being transmitted from different surface sensors, different downhole sensors, and/or from a surface sensor and a downhole sensor that are asynchronous relative to one another and the actual time interval over which the drilling conditions on which said data streams are based were initially detected. These machine learning algorithms may be run to establish correlations between data streams received from different sensors using pattern recognition.

In response to a determination that the first and second data streams 410 and 415 are asynchronous with each other and relative to the time interval, the synchronization engine 365 determines an extent to which the first and second data streams 410 and 415 are asynchronous. Based on the extent to which the first and second data streams 410 and 415 are asynchronous, the synchronization engine 365 synchronizes the first and second data streams 410 and 415 along the time interval. Finally, the synchronization engine 365 sends the synchronized first and second data streams 410 and 415 to the interface engine 350, as indicated by arrow 462.

In those embodiments utilizing machine learning algorithms, once the correlations between data streams received from different sensors are established using pattern recognition, the misalignments between various data streams can be detected and corrected. More particularly, by using machine learning to analyze signal patterns of separate data streams corresponding to either the same or different drilling conditions, the synchronization engine 365 is able to compare patterns from different sources to determine the offset time(s) of various data streams with respect to a reference clock set by the user. In some embodiments, once the offset is detected, the user is alerted based on predetermined thresholds (which may be set by the user) that depend upon the criticality of the particular drilling condition(s) being monitored in the context of the wellbore operation being executed. For example, the user may determine that an offset of less than +/−10 second is acceptable and therefore requires no correction by the synchronization engine 365. In some embodiments, the user may map and configure various data streams (i.e., channels) coming in from various sources according to his or her preferences. In some embodiments, the machine learning algorithm of the synchronization engine 365 utilizes historical data streams received from other well segments (and/or other wells) to identify patterns between various data streams. For example, the machine learning algorithm may utilize historical data streams associated with particular regions, formations, drilling operations, or the like. In some embodiments, the synchronization engine 365 merely suggests a correction to the user via the interface engine 350 and, if the user accepts the correction, the synchronization engine 365 adds the accepted pattern to its bank of historical data for future use as part of the machine learning algorithm.

Figure 7B:
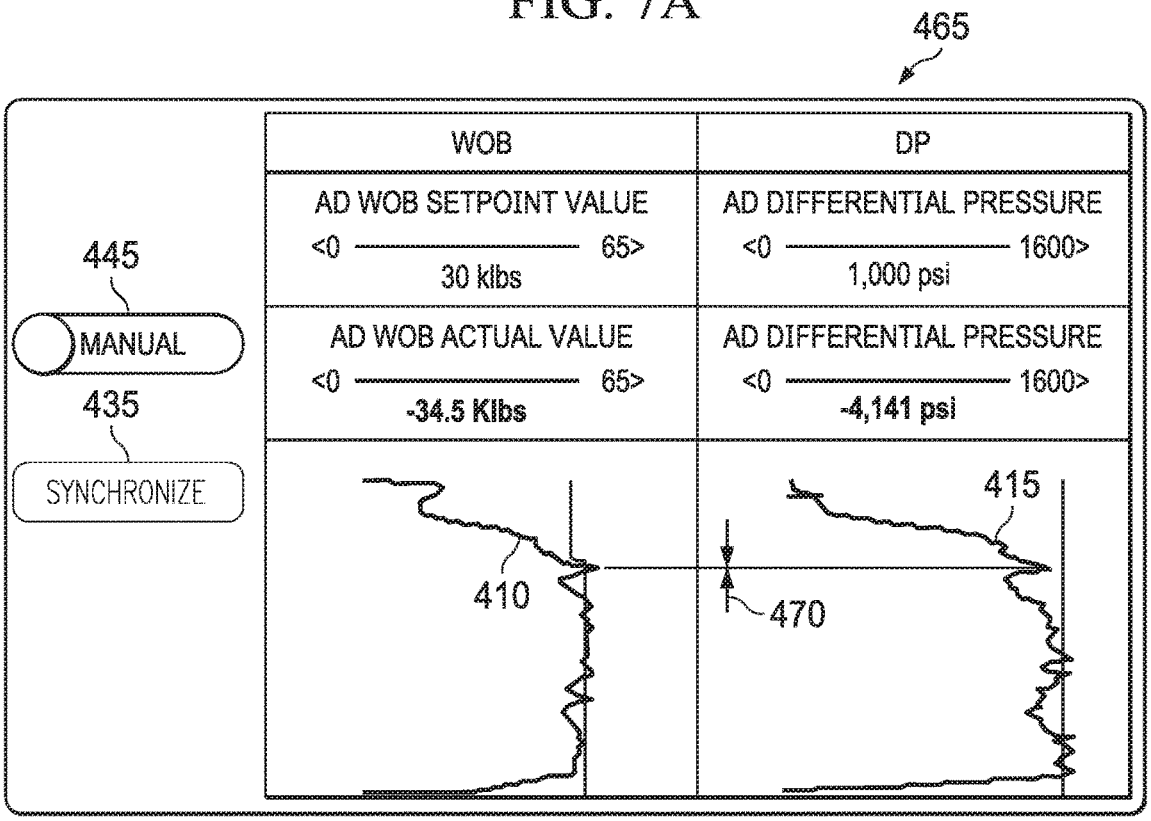
FIG. 7B is an enlarged graphical view of another user interface displayed during at least another portion of the well system operation shown in FIG. 5, according to one or more embodiments of the present disclosure.

At least a portion of an example graphical user interface 465 generated as a result of the synchronized first and second data streams 410 and 415 being sent to the interface engine 350 is illustrated in FIG. 7B. As a result, there may be a substantial alignment of the first and second data streams 410 and 415 along the time axis 420—this alignment is referred to in FIG. 7B by the reference numeral 470. However, in some embodiments, the interface engine 350 may require user input(s) 475 from, for example, the "synchronize" button 435 before displaying the synchronized first and second data streams 410 and 415 to the user via the graphical user interface 465, as indicated by arrow 480.

Figure 8:
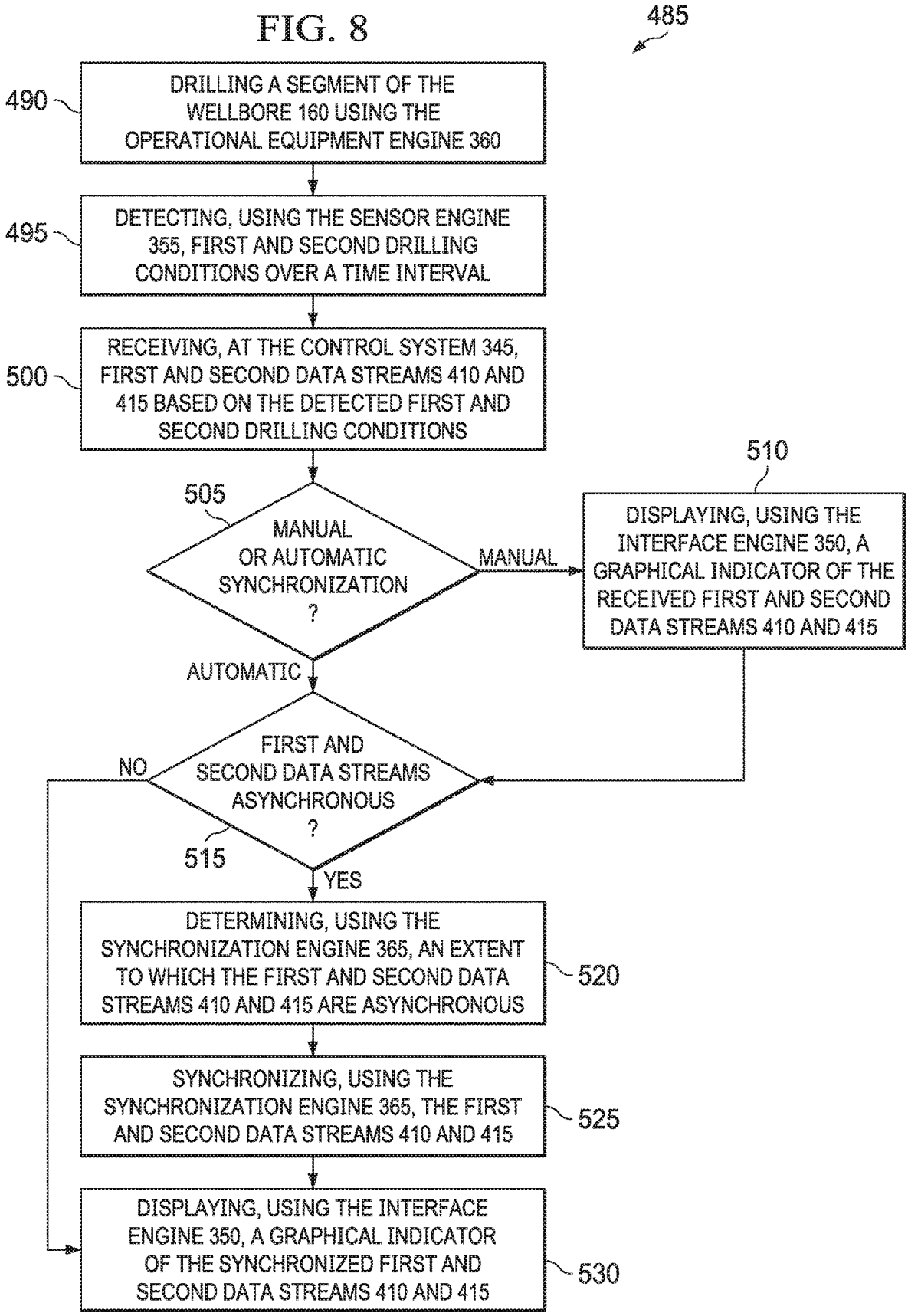
FIG. 8 is a flow diagram of a method for implementing one or more embodiments of the present disclosure.

In an embodiment, as illustrated in FIG. 8, a method of operating the system 340 to synchronize first and second data streams 410 and 415 is generally referred to by the reference numeral 485. The method 485 is carried out in response to control signals being sent from the control system 345 to the operational equipment engine 360. The method 485 includes at step 490 drilling a segment of the wellbore 160 using the operational equipment engine 360 of the drilling system 340. At a step 495, during the drilling of the well segment, first and second drilling conditions are detected over a time interval using first and second sensors, respectively, of the sensor engine 355. At a step 500, first and second data streams 410 and 415 based on the detected first and second drilling conditions, respectively, are received at a surface location (e.g., at the control system 345). In some embodiments, at a step 505, a user chooses between manual or automatic synchronization of the first and second data streams 410 and 415. At a step 510, in response to choosing manual synchronization of the first and second data streams 410 and 415, a graphical indicator of the first and second data streams 410 and 415 is displayed using the interface engine 350. At a step 515, after displaying the graphical indicator of the first and second data streams 410 and 415 at the step 510, or in response to choosing automatic synchronization of the first and second data streams 410 and 415 at the step 505, it is determined, based on a relationship between the first and second drilling conditions, whether the first and second data streams 410 and 415 are asynchronous with each other (and relative to the time interval over which the first and second data streams 410 and 415 were detected by the sensor engine 355). In response to a determination that the first and second data streams 410 and 415 are asynchronous with each other and relative to the time interval: at a step 520 an extent to which the first and second data streams 410 and 415 are asynchronous is determined by the synchronization engine 365; and, at a step 525, based on the extent to which the first and second data streams 410 and 415 are asynchronous, the first and second data streams 410 and 415 are synchronized by the synchronization engine 365. Finally, at a step 530, in response to synchronization of the first and second data streams 410 and 415 by the synchronization engine 365, or a determination at the step 515 that the first and second data streams 410 and 415 are not asynchronous, a graphical indicator of the synchronized first and second data streams 410 and 415 is displayed using the interface engine 350.

In some embodiments, the operation of the system 340 and/or the execution of the method 485 contextualizes multiple data streams in a manner that allows for proper evaluation of performance and possible tool failures under varying downhole conditions. Although described herein with respect to "first and second data streams," the system 340 and or the method 485 may be utilized to synchronize more than two data streams (e.g., three, four, five, six, seven, eight, nine, ten, or more data streams may be synchronized using the system 340 and/or the method 485). For example, the system 340 and/or the method 485 may be utilized to synchronize multiple synchronized data streams against another asynchronous data stream. Thus, the system 340 and/or the method 485 may be utilized iteratively to achieve synchronization of more than two data streams.

As used herein, the term "at or near" a well segment may refer to any subterranean location located within a distance of 1, 2, 5, 10, 20, 30, 40, 50, 100, 200, or more feet from the well segment. Moreover, as used herein, the term "at or near" a drilling rig may refer to any aboveground location located within a distance of 1, 2, 5, 10, 20, 30, 40, 50, 100, 200, or more feet from the drilling rig (or any component thereof).

Figure 9:
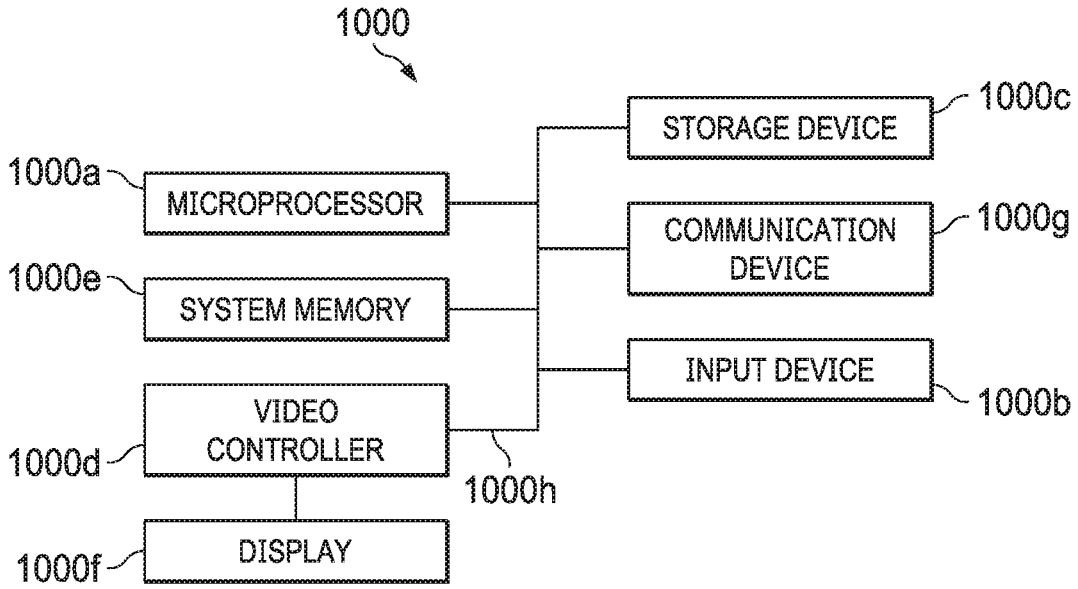
FIG. 9 is a diagrammatic illustration of a computing node for implementing one or more embodiments of the present disclosure.

In an embodiment, as illustrated in FIG. 9, a computing node 1000 for implementing one or more embodiments of one or more of the above-described elements, systems (e.g., 100, 210, and/or 340), methods (e.g., 485) and/or steps (e.g., 490, 495, 500, 505, 510, 515, 520, 525, and/or 530), and/or any combination thereof, is depicted. The node 1000 includes a microprocessor 1000*a*, an input device 1000*b*, a storage device 1000*c*, a video controller 1000*d*, a system memory 1000*e*, a display 1000*f*, and a communication device 1000*g* all interconnected by one or more buses 1000*h*. In several embodiments, the storage device 1000*c* may include a floppy drive, hard drive, CD-ROM, optical drive, any other form of storage device and/or any combination thereof. In several embodiments, the storage device 1000*c* may include, and/or be capable of receiving, a floppy disk, CD-ROM, DVD-ROM, or any other form of computer-readable medium that may contain executable instructions. In several embodiments, the communication device 1000*g* may include a modem, network card, or any other device to enable the node 1000 to communicate with other nodes. In several embodiments, any node represents a plurality of interconnected (whether by intranet or Internet) computer systems, including without limitation, personal computers, mainframes, PDAs, smartphones and cell phones.

In several embodiments, one or more of the components of any of the above-described systems include at least the node 1000 and/or components thereof, and/or one or more nodes that are substantially similar to the node 1000 and/or components thereof. In several embodiments, one or more of the above-described components of the node 1000 and/or the above-described systems include respective pluralities of same components.

In several embodiments, a computer system typically includes at least hardware capable of executing machine readable instructions, as well as the software for executing acts (typically machine-readable instructions) that produce a desired result. In several embodiments, a computer system may include hybrids of hardware and software, as well as computer sub-systems.

In several embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In several embodiments, hardware may include any physical device that is capable of storing machine-readable instructions, such as memory or other data storage devices. In several embodiments, other forms of hardware include hardware sub-systems, including transfer devices such as modems, modem cards, ports, and port cards, for example.

In several embodiments, software includes any machine code stored in any memory medium, such as RAM or ROM, and machine code stored on other devices (such as floppy disks, flash memory, or a CD ROM, for example). In several embodiments, software may include source or object code. In several embodiments, software encompasses any set of instructions capable of being executed on a node such as, for example, on a client machine or server.

In several embodiments, combinations of software and hardware could also be used for providing enhanced functionality and performance for certain embodiments of the present disclosure. In an embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In several embodiments, computer readable mediums include, for example, passive data storage, such as a random access memory (RAM) as well as semi-permanent data storage such as a compact disk read only memory (CD-ROM). One or more embodiments of the present disclosure may be embodied in the RAM of a computer to transform a standard computer into a new specific computing machine. In several embodiments, data structures are defined organizations of data that may enable an embodiment of the present disclosure. In an embodiment, a data structure may provide an organization of data, or an organization of executable code.

In several embodiments, any networks and/or one or more portions thereof, may be designed to work on any specific architecture. In an embodiment, one or more portions of any networks may be executed on a single computer, local area networks, client-server networks, wide area networks, internets, hand-held and other portable and wireless devices and networks.

In several embodiments, a database may be any standard or proprietary database software, such as Oracle, Microsoft Access, SyBase, or DBase II, for example. In several embodiments, the database may have fields, records, data, and other database elements that may be associated through database specific software. In several embodiments, data may be mapped. In several embodiments, mapping is the process of associating one data entry with another data entry. In an embodiment, the data contained in the location of a character file can be mapped to a field in a second table. In several embodiments, the physical location of the database is not limiting, and the database may be distributed. In an embodiment, the database may exist remotely from the server, and run on a separate platform. In an embodiment, the database may be accessible across the Internet. In several embodiments, more than one database may be implemented.

In several embodiments, a plurality of instructions stored on a computer readable medium may be executed by one or more processors to cause the one or more processors to carry out or implement in whole or in part the above-described operation of each of the above-described elements, systems (e.g., 100, 210, and/or 340), methods (e.g., 485) and/or steps (e.g., 490, 495, 500, 505, 510, 515, 520, 525, and/or 530), and/or any combination thereof. In several embodiments, such a processor may include one or more of the microprocessor 1000*a*, any processor(s) that are part of the components of the above-described systems, and/or any combination thereof, and such a computer readable medium may be distributed among one or more components of the above-described systems. In several embodiments, such a processor may execute the plurality of instructions in connection with a virtual computer system. In several embodiments, such a plurality of instructions may communicate directly with the one or more processors, and/or may interact with one or more operating systems, middleware, firmware, other applications, and/or any combination thereof, to cause the one or more processors to execute the instructions.

A method has been disclosed. The method generally includes drilling a well segment using a drilling rig; during the drilling of the well segment, detecting, using first and second sensors, first and second drilling conditions, respectively, over a time interval; receiving, at a surface location, first and second data streams based on the detected first and second drilling conditions, respectively; after receiving the first and second data streams at the surface location, determining, based on a relationship between the first and second drilling conditions, whether the first and second data streams are asynchronous with each other and relative to the time interval; and in response to a determination that the first and second data streams are asynchronous with each other and relative to the time interval: determining an extent to which the first and second data streams are asynchronous; and based on the extent to which the first and second data streams are asynchronous, synchronizing the first and second data streams.

The foregoing method embodiment may include one or more of the following elements, either alone or in combination with one another:

Before determining whether the first and second data streams are asynchronous with each other and relative to the time interval, displaying a graphical indicator of the first and second data streams.

After synchronizing the first and second data streams, displaying a graphical indicator of the synchronized first and second data streams.

The first sensor is a downhole sensor and the first drilling condition is a downhole condition at or near the well segment.

The second sensor is a surface sensor and the second drilling condition is a surface condition at or near the drilling rig.

The first drilling condition is differential pressure and the first sensor is a differential pressure sensor; and the second drilling condition is weight-on-bit and the second sensor is a weight-on-bit sensor.

A system has also been disclosed. The system generally includes an operational equipment engine adapted to drill a well segment; a sensor engine associated with the operational equipment engine and adapted to detect first and second drilling conditions over a time interval during the drilling of the well segment; and a synchronization engine adapted to: determine, after first and second data streams based on the first and second drilling conditions, respectively, are received at a surface location, whether the first and second data streams are asynchronous with each other and relative to the time interval; and in response to a determination that the first and second data streams are asynchronous with each other and relative to the time interval: determine an extent to which the first and second data streams are asynchronous; and based on the extent to which the first and second data streams are asynchronous, synchronize the first and second data streams.

The foregoing system embodiment may include one or more of the following elements, either alone or in combination with one another:

An interface engine adapted to display a graphical indicator of the first and second data streams before the synchronization engine determines whether the first and second data streams are asynchronous with each other and relative to the time interval.

An interface engine adapted to display a graphical indicator of the synchronized first and second data streams after the first and second data streams are synchronized by the synchronization engine.

The sensor engine includes first and second sensors adapted to detect the first and second drilling conditions, respectively.

The first sensor is a downhole sensor and the first drilling condition is a downhole condition at or near the well segment.

The operational equipment engine is, includes, or is part of a drilling rig; and the second sensor is a surface sensor and the second drilling condition is a surface condition at or near the drilling rig.

The first drilling condition is differential pressure and the first sensor is a differential pressure sensor; and the second drilling condition is weight-on-bit and the second sensor is a weight-on-bit sensor.

An apparatus has also been disclosed. The apparatus generally includes a non-transitory computer readable medium; and a plurality of instructions stored on the non-transitory computer readable medium and executable by one or more processors, the plurality of instructions comprising: instructions that, when executed, cause the one or more processors to drill a well segment using an operational equipment engine; instructions that, when executed, cause the one or more processors to detect, using a sensor engine associated with the operational equipment engine, first and second drilling conditions over a time interval during the drilling of the well segment; instructions that, when executed, cause the one or more processors to determine, using a synchronization engine and after first and second data streams based on the first and second drilling conditions, respectively, are received at a surface location, whether the first and second data streams are asynchronous with each other and relative to the time interval; and instructions that, when executed, cause the one or more processors, in response to a determination that the first and second data streams are asynchronous with each other and relative to the time interval, to: determine, using the synchronization engine, an extent to which the first and second data streams are asynchronous; and based on the extent to which the first and second data streams are asynchronous, synchronize, using the synchronization engine, the first and second data streams.

The foregoing apparatus embodiment may include one or more of the following elements, either alone or in combination with one another:

The plurality of instructions further comprise instructions that, when executed, cause the one or more processors to display, using an interface engine, a graphical indicator of the first and second data streams before the synchronization engine determines whether the first and second data streams are asynchronous with each other and relative to the time interval.

The plurality of instructions further comprise instructions that, when executed, cause the one or more processors to display, using an interface engine, a graphical indicator of the synchronized first and second data streams after the first and second data streams are synchronized by the synchronization engine.

The sensor engine includes first and second sensors adapted to detect the first and second drilling conditions, respectively.

The first sensor is a downhole sensor and the first drilling condition is a downhole condition at or near the well segment.

The operational equipment engine is, includes, or is part of a drilling rig; and the second sensor is a surface sensor and the second drilling condition is a surface condition at or near the drilling rig.

The first drilling condition is differential pressure and the first sensor is a differential pressure sensor; and the second drilling condition is weight-on-bit and the second sensor is a weight-on-bit sensor.

It is understood that variations may be made in the foregoing without departing from the scope of the present disclosure.

In some embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In some embodiments, while different steps, processes, and procedures are described as appearing as distinct acts, one or more of the steps, one or more of the processes, and/or one or more of the procedures may also be performed in different orders, simultaneously and/or sequentially. In some embodiments, the steps, processes, and/or procedures may be merged into one or more steps, processes and/or procedures.

In some embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although some embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A method, comprising:

drilling a well segment using a drilling rig;

during the drilling of the well segment, detecting, using first and second sensors, first and second drilling conditions, respectively, over a time interval;

receiving, at a surface location, first and second data streams based on the detected first and second drilling conditions, respectively;

receiving, at the surface location, a user's first input, which first input comprises the user's selection of a manual mode or an automatic mode;

after receiving the first and second data streams and the user's first input at the surface location, determining, based on a relationship between the first and second drilling conditions, whether the first and second data streams are asynchronous with each other and relative to the time interval; and in response to a determination that the first and second data streams are asynchronous with each other and relative to the time interval:

determining an extent to which the first and second data streams are asynchronous; and based on the extent to which the first and second data streams are asynchronous, synchronizing the first and second data streams;

wherein the first input comprises the user's selection of the manual mode; and wherein, in the manual mode, the step of determining whether the first and second data streams are asynchronous with each other and relative to the time interval comprises:

a user manually recognizing misalignment(s) between characteristics of the first and second data streams; and the user providing a second input to trigger the determination of the extent to which the first and second data streams are asynchronous and the subsequent synchronization of the first and second data streams.

2. The method of claim 1, further comprising, before determining whether the first and second data streams are asynchronous with each other and relative to the time interval, displaying a graphical indicator of the first and second data streams.

3. The method of claim 1, further comprising, after synchronizing the first and second data streams, displaying a graphical indicator of the synchronized first and second data streams.

4. The method of claim 1, wherein the first sensor is a downhole sensor and the first drilling condition is a downhole condition at or near the well segment.

5. The method of claim 1, wherein the second sensor is a surface sensor and the second drilling condition is a surface condition at or near the drilling rig.

6. The method of claim 1, wherein the first drilling condition is differential pressure and the first sensor is a differential pressure sensor; and wherein the second drilling condition is weight-on-bit and the second sensor is a weight-on-bit sensor.

7. A system, comprising:

an operational equipment engine adapted to drill a well segment;

a sensor engine associated with the operational equipment engine and adapted to detect first and second drilling conditions over a time interval during the drilling of the well segment; and a synchronization engine adapted to:

determine, after first and second data streams based on the first and second drilling conditions, respectively, and a user's first input are received at a surface location, whether the first and second data streams are asynchronous with each other and relative to the time interval, the first input comprising the user's selection of a manual mode or an automatic mode; and in response to a determination that the first and second data streams are asynchronous with each other and relative to the time interval:

determine an extent to which the first and second data streams are asynchronous; and based on the extent to which the first and second data streams are asynchronous, synchronize the first and second data streams;

wherein the first input comprises the user's selection of the manual mode; and wherein, in the manual mode, the synchronization engine determines whether the first and second data streams are asynchronous with each other and relative to the time interval by prompting a user to:

manually recognize misalignment(s) between characteristics of the first and second data streams; and provide a second input to trigger the determination of the extent to which the first and second data streams are asynchronous and the subsequent synchronization of the first and second data streams.

8. The system of claim 7, further comprising an interface engine adapted to display a graphical indicator of the first and second data streams before the synchronization engine determines whether the first and second data streams are asynchronous with each other and relative to the time interval.

9. The system of claim 7, further comprising an interface engine adapted to display a graphical indicator of the synchronized first and second data streams after the first and second data streams are synchronized by the synchronization engine.

10. The system of claim 7, wherein the sensor engine includes first and second sensors adapted to detect the first and second drilling conditions, respectively.

11. The system of claim 10, wherein the first sensor is a downhole sensor and the first drilling condition is a downhole condition at or near the well segment.

12. The system of claim 10, wherein the operational equipment engine is, includes, or is part of a drilling rig; and wherein the second sensor is a surface sensor and the second drilling condition is a surface condition at or near the drilling rig.

13. The system of claim 10, wherein the first drilling condition is differential pressure and the first sensor is a differential pressure sensor; and wherein the second drilling condition is weight-on-bit and the second sensor is a weight-on-bit sensor.

14. An apparatus, comprising:

a non-transitory computer readable medium; and a plurality of instructions stored on the non-transitory computer readable medium and executable by one or more processors, wherein, when the instructions are executed by the one or more processors, the following steps are executed:

drilling a well segment using an operational equipment engine;

during the drilling of the well segment, detecting, using a sensor engine associated with the operational equipment engine, first and second drilling conditions over a time interval;

receiving, at a surface location, first and second data streams based on the detected first and second drilling conditions;

receiving, at the surface location, a user's first input, which first input comprises the user's selection of a manual mode or an automatic mode;

after receiving the first and second data streams and the user's first input at the surface location, determining, using a synchronization engine and based on a relationship between the first and second drilling conditions, whether the first and second data streams are asynchronous with each other and relative to the time interval; and in response to a determination that the first and second data streams are asynchronous with each other and relative to the time interval:

determining, using the synchronization engine, an extent to which the first and second data streams are asynchronous; and based on the extent to which the first and second data streams are asynchronous, synchronizing, using the synchronization engine, the first and second data streams;

wherein the first input comprises the user's selection of the manual mode; and wherein, in the manual mode, the step of determining whether the first and second data streams are asynchronous with each other and relative to the time interval comprises:

a user manually recognizing misalignment(s) between characteristics of the first and second data streams; and the user providing a second input to trigger the determination of the extent to which the first and second data streams are asynchronous and the subsequent synchronization of the first and second data streams.

15. The apparatus of claim 14, wherein, when the instructions are executed by the one or more processors, the following step is further executed:

displaying, using an interface engine, a graphical indicator of the first and second data streams before the synchronization engine determines whether the first and second data streams are asynchronous with each other and relative to the time interval.

16. The apparatus of claim 14, wherein, when the instructions are executed by the one or more processors, the following step is further executed:

displaying, using an interface engine, a graphical indicator of the synchronized first and second data streams after the first and second data streams are synchronized by the synchronization engine.

17. The apparatus of claim 14, wherein the sensor engine includes first and second sensors adapted to detect the first and second drilling conditions, respectively.

18. The apparatus of claim 17, wherein the first sensor is a downhole sensor and the first drilling condition is a downhole condition at or near the well segment.

19. The apparatus of claim 17, wherein the operational equipment engine is, includes, or is part of a drilling rig; and wherein the second sensor is a surface sensor and the second drilling condition is a surface condition at or near the drilling rig.

20. The apparatus of claim 17, wherein the first drilling condition is differential pressure and the first sensor is a differential pressure sensor; and wherein the second drilling condition is weight-on-bit and the second sensor is a weight-on-bit sensor.

* * * * *